US006500789B1

(12) United States Patent
Wiltz et al.

(10) Patent No.: US 6,500,789 B1
(45) Date of Patent: Dec. 31, 2002

(54) ANTI-CORROSION LUBRICANT FOR POLLUTION SENSITIVE USES

(75) Inventors: Jerald David Wiltz, Melville, LA (US); Rayphael James Aucion, Opelousas, LA (US)

(73) Assignee: Ventura Foods, LLC, City of Industry, CA (US)

( * ) Notice: Subject to any disclaimer, the term of this patent is extended or adjusted under 35 U.S.C. 154(b) by 0 days.

(21) Appl. No.: 09/976,374

(22) Filed: Oct. 11, 2001

(51) Int. Cl.[7] ..... C10M 161/00
(52) U.S. Cl. ..... 508/472; 508/584; 508/491
(58) Field of Search ..... 508/472, 584, 508/491

(56) References Cited

U.S. PATENT DOCUMENTS 5,116,629 A * 5/1992 Schroeder et al. ..... 426/545
5,538,654 A * 7/1996 Lawate et al. ..... 508/308
5,958,851 A * 9/1999 Cannon et al. ..... 508/491
5,972,855 A * 10/1999 Honary ..... 508/491
6,004,909 A * 12/1999 Lindman ..... 508/174
6,087,308 A * 7/2000 Butler et al. ..... 508/486
6,090,761 A * 7/2000 Butler et al. ..... 508/486
6,159,913 A * 12/2000 Cannon et al. ..... 508/491
6,172,248 B1 * 1/2001 Copeland et al. ..... 554/190
6,288,012 B1 * 9/2001 Li et al. ..... 508/113

* cited by examiner

*Primary Examiner*—Jacqueline V. Howard
(74) *Attorney, Agent, or Firm*—George W. Finch

(57) ABSTRACT

An economical lubricant blended from refined bleached deodorized soybean oil, a food grade. additive that confers "tack" or stringiness, and a food grade anti-oxidant. The preferred food grade additive that confers "tack" is FUNCTIONAL V-584 and the preferred food grade anti-oxidant is TENOX 20A.

18 Claims, No Drawings

ANTI-CORROSION LUBRICANT FOR POLLUTION SENSITIVE USES

TECHNICAL FIELD

This invention relates to economical lubricants that have no, toxic ingredients so that they can be used to lubricate and/or rust protect machinery without danger of polluting products made by the machinery or the environment surrounding the machinery.

BACKGROUND OF THE INVENTION

Machinery that processes and handles food and food products, requires lubricants, usually in such proximity to the food or food product that small amounts of such lubricants end up in the food.

The regulations of the Federal Food and Drug Administration (F.D.A.) prohibit the inclusion of materials in food unless the materials have been specifically approved by the Agency. Most mineral oils fall within such prohibition, so vegetable oils such as soybean oils, are commonly used as lubricants. Although such oils are effective, they have undesirable temperature/viscosity characteristics and can become rancid. Therefore, "white oils"have been developed for use with food machinery. White oils are characteristically colorless, odorless, and tasteless mineral oils produced by treating light industrial oils with acid and then neutralizing the resultant with a strong base. The treatment removes aromatics and olefins from such oils, resulting in benign oil products that are relatively non-reactive. Consequently, white oils are widely used in the food, drug, and cosmetic industries due to their non-staining properties, as well as their inertness, and particularly because of their freedom from toxic effects.

White oils have significant drawbacks, however, important in certain situations, in that they exhibit relatively high pour points as a result of the substantial amounts of wax contained in the oils and they are expensive. The wax present tends to leave solution when the oils are cooled, resulting in increased viscosity and making the oils difficult to handle, particularly at lower temperatures. While white oils derived from naphthenic mineral oils contain somewhat less wax than those produced from paraffinic materials, even the former oils can contain 10% or more wax, on a weight basis.

Normally, "dewaxing aids" would be used to assist in the filtration of wax particles precipitated during wax-removing, chilling procedures by reducing the size of the precipitated particles, thus making them easier to filter. Such treatment is not feasible for white oils, however, because of their market applications in the food area, and the fact that such "aids" have not received approval of the F.D.A., and could at least in part remain in the oil following the wax-removal step.

Another approach used in enhancing the low-temperature handling characteristics of ordinary mineral oils involves the use of pour point depressants such as high molecular weight compositions formed by the alkylation of benzene, or derivatives thereof, by the polymerization of lower molecular weight methacrylates, or by condensation polymerizations involving compounds of various kinds. However, as in the case of dewaxing aids, the use of such materials cannot be use in association with foodstuffs because they have not received F.D.A. approvals.

Ethylene-vinyl acetatecopolymers have in the past been used as pour point depressants in petroleum products and white oils, since such copolymers have received approvals of the FDA for use in contact with foodstuffs. However, they have not been used in lubricants where much more economical vegetable oils are the primary ingredient.

Other lubricants such as those including distilled acetylated monoglycarides and vegetable oils as described in U.S. Pat. No. 5,593,682 work well in bottle capping operations, but are about eight times more expensive to use than the present invention.

SUNMARY OF THE INVENTION

The present invention is a lubricant for use in food production applications to lubricate packaging equipment, mainly in the bottle capping industry to lubricate bottle cap crimping equipment. Other possible uses of the present invention include general lubrication of various types of food machinery, as an anti-corrosion coating for food production equipment including automated baking equipment and as an ecologically frendly antirust coating and lubricant for machinery, where pollution due to machine operation is a problem. Although it is not intended for use in a consumable product, it is non-toxic and can be consumed by humans without injury. The present lubricant includes economical constituents so that the present lubricant can be made available to industry at much lower cost than competing lubricants.

The present lubricant is primarily refined bleached deodorized soybean oil to which a food grade additive that confers "tack" or stringiness and a food grade anti-oxidant are added. In experimental use, the lubrication properties are as good or better than other known food grade lubricants sold for bottle capping applications.

Therefore it is an object to provide an economic food grade lubricant.

Another object is to provide a food grade lubricant that can be used in the rigorous mechanical environment of bottle capping machines.

Another object is to provide a food grade lubricant which is non-toxic and can be blended from commercially available ingredients.

Another object is to provide a food grade lubricant and/or anti-rust compound that can be used in pollution sensitive environments.

Another object is to provide a food grade material which can be used as a corrosion resisting coating.

These and other objects of the present invention will become apparent to those skilled in the art after considering the following detailed description of the preferred embodiments.

DESCRIPTION OF A PREFERRED EMBODIMENT

The present invention is a blend of economical food grade ingredients used to form a relatively inexpensive lubricant. It has received rabbinical approval for use during the production of kosher foods.

The present lubricant is primarily refined bleached deodorized soybean oil to which a food grade additive that confers "tack" or stringiness and a food grade anti-oxidant are added.

A suitable tack producing additive, which is available from Functional Products Inc. of Macedonia, Ohio as FUNCTIONAL V-584, includes:

at least 20 weight % of a proprietary copolymer; and about 80 weight % vegetable oil.

The normal use of FUNCTIONAL V-584 is for blending in fatty oil based chain saw lubricants for use in environmentally sensitive locations. The proprietary copolymer is believed to be an ethylene-vinyl acetate copolymer, the weight ratio of vinyl acetate to ethylene in said polymer being from about 25 vinyl acetate to about 75 ethylene, to about 55 vinyl acetate to about 45 ethylene, and the average molecular weight of said copolymer is from about 500 to about 10,000. FUNCTIONAL V-584 may also include: acrylic acid, methyl acrylate, methyl methacrylate, methacrylic acid, ethyl acrylate, or an alpha-olefin.

A suitable anti-oxidant additive, which is available from the Eastman Chemical Company of Kingsport, Tenn. as TENOX 20A, includes:

32 weight % glyceryl monooleate;

30 weight % corn oil;

20 weight % tert-butylhydtoquinone;

15 weight % propylene glycol; and 3 weight % citric acid.

A preferred formulation includes:

89.3 to 98.2 weight % refined bleached deodorized soybean oil;

1.5 to 10 weight % tack producing additive; and 0.03 to 0.50 weight % anti-oxidant.

Normally about 2 weight % tack producing additive is suitable for lubricant used in bottle capping machines with additional FUNCTIONAL V-584 being added if additional viscosity is required.

Various formulations were tested in a production bottle capping line with the following results:

Formula 1 refined bleached deodorized soybean oil;

2 weight % of FUNCTIONAL V-584; and 500 ppm of TENOX 20 for shelf life.

A trial run extended over 5 working days at 12 hours per day (60 hours running time). The trial run consisted of the capper operator conducting the normal startup procedure and replacing the normal lubricant with the present invention. This startup procedure consists of washing down the heads of the capper, lubricating each wheel of each head, and starting up the line. The operator used the present invention at approximately the same proportion as the normal lubricant, and maintained the lubricity needed for the capping equipment by occasionally applying formula 1 using a spray bottle. Several cut caps were discovered during the run, but this was most likely do to defective containers. Container problems were noted throughout the run with containers breaking in the filler and in the capper. When a container breaks in the capper, the operator must wash down the capper before restarting the line. Container breakage has been an ongoing problem and is a result of weak containers, not lack of lubricant. In conclusion, the present invention performed as good as the normal lubricant at a fraction of the cost.

Formula 2 refined bleached deodorized soybean oil;

1.25 weight % of V-584; and 500 ppm of TENOX 20 for shelf life.

Under the same conditions as for Formula 1, Formula 2 did not perform as well as it had to be added more frequently than Formula 1.

Formula 3 refined bleached deodorized soybean oil;

5 weight % of V-584; and 500 ppm of TENOX 20 for shelf life.

Formula 3 when placed in a spray bottle was too viscous to spray from the bottle with the normal nozzle size. Since Formula 1 supplied sufficient lubrication when the normal application method was used at the bottling plant, no attempt was made to seek an alternate application method.

Thus there has been described a novel economical food lubricant, formulation and method of use, which fulfill all the objects and advantages sought therefor. Many changes, modifications, variations and applications of the subject invention will become apparent to those skilled in the art after consideration of the specification and accompanying drawings. All such changes, modifications, alterations and other uses and applications which do not depart from the spirit and scope of the invention are deemed to be covered by the invention which is limited only by the claims that follow:

What is claimed is:

1. A food grade lubricant including:

vegetable oil;

ethylene-vinyl acetate copolymer; and preservative including:

tert-butylhydroquinone.

2. The food grade lubricant as defined in claim 1 wherein said preservative further includes:

glyceryl monooleate;

propylene glycol; and citric acid.

3. The food grade lubricant as defined in claim 1 wherein said vegetable oil is primarily:

refined bleached deodorized soybean oil.

4. The food grade lubricant as defined in claim 1 having a weight % formula wherein said vegetable oil is:

89.3 to 98.2 weight % refined bleached deodorized soybean oil of the total, said ethylene-vinyl acetate copolymer is:

0.3 to 2 weight % of the total, and said preservative includes:

0.006 to 0.014 weight % tert-butylhydroquinone of the total.

5. A food grade lubricant including primarily:

refined bleached deodorized soybean oil, and also including:

tack producing additive; and anti-oxidant.

6. The food grade lubricant as defined in claim 5 having a formulation including:

89.3 to 98.2 weight % refined bleached deodorized soybean oil;

1.5 to 10 weight % of said tack producing additive; and 0.03 to 0.50 weight % of said anti-oxidant.

7. The food grade lubricant as defined in claim 5 wherein said tack producing additive includes:

ethylene-vinyl acetate copolymer.

8. The food grade lubricant as defined in claim 5 wherein said anti-oxidant is:

32 weight % glyceryl monooleate;

30 weight % corn oil;

20 weight % tert-butylhydroquinone;

15 weight % propylene glycol; and 3 weight % citric acid.

9. The food grade lubricant as defined in claim 5 wherein said tack producing additive is:

at least 20 weight % of an ethylene-vinyl acetate copolymer; and about 80 weight % vegetable oil.

10. The food grade lubricant as defined in claim 9 wherein said ethylene-vinyl acetate copolymer has a weight ratio of vinyl acetate to ethylene from about 25 vinyl acetate to about 75 ethylene to about 55 vinyl acetate to about 45 ethylene, and an average molecular weight of from about 500 to about 10,000.

11. The food grade lubricant as defined in claim 5 wherein said anti-oxidant is:

glyceryl monooleate;

corn oil;

tert-butylhydroquinone;

propylene glycol; and citric acid.

12. The food grade lubricant as defined in claim 6 wherein said anti-oxidant is:

32 weight % glyceryl monooleate;

30 weight % corn oil;

20 weight % tert-butylhydroquinone;

15 weight % propylene glycol; and 3 weight % citric acid.

13. A method to lubricate and/or prevent corrosion of food machinery including:

applying a blend of vegetable oil and ethylene-vinyl acetate copolymer of up to 2 weight % to the machinery.

14. The method defined in claim 13 wherein the blend also inicludes an anti-oxidant preservative.

15. The method defined in claim 13 wherein the blend includes:

an anti-oxidant preservative consisting of:

32 weight % glyceryl. monooleate;

30 weight % corn oil;

20 weight % tert-butylhydroquinone;

15 weight % propylene glycol; and 3 weight % citric acid.

16. The method defined in claim 13 wherein the ethylene-vinyl acetate copolymer has a weight ratio of vinyl acetate to ethylene from about 25 vinyl acetate to about 75 ethylene to about 55 vinyl acetate to about 45 ethylene, and an average molecular weight of from about 500 to about 10,000.

17. The method defined in claim 16 wherein the blend includes:

tert-butylhydroquinone.

18. The method defined in claim 13 wherein said applying is:

spraying.

* * * * *